US005961297A

United States Patent [19]

Haga et al.

[11] Patent Number: 5,961,297

[45] **Date of Patent: *Oct. 5, 1999**

[54] OIL-FREE TWO STAGE SCROLL VACUUM PUMP AND METHOD FOR CONTROLLING THE SAME PUMP

[75] Inventors: Shuji Haga; Masaru Tsuchiya, both of Tokohama, Japan

[73] Assignee: Iwata Air Compressor Mfg. Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/608,191

[22] Filed: Feb. 28, 1996

[30] Foreign Application Priority Data

Feb. 28, 1995 [JP] Japan ..... 7-065128
Mar. 31, 1995 [JP] Japan ..... 7-100057

[51] Int. Cl.[6] ..... F04B 49/08

[52] U.S. Cl. ..... 417/310; 417/252; 418/55.1; 418/15; 418/5

[58] Field of Search ..... 417/252, 310; 418/9, 15, 55.1

[56] References Cited

U.S. PATENT DOCUMENTS

| | | | |
|---|---|---|---|
| 4,295,794 | 10/1981 | Cain . | |
| 4,545,747 | 10/1985 | Tamura et al. | 418/55 |
| 4,650,405 | 3/1987 | Iwanami et al. | 418/5 |
| 4,856,965 | 8/1989 | Katsuie et al. | 417/19 |
| 5,040,949 | 8/1991 | Crinquette et al. . | |
| 5,160,244 | 11/1992 | Kuwabara et al. | 417/36 |
| 5,358,387 | 10/1994 | Suzuki et al. . | |
| 5,542,828 | 8/1996 | Grenci et al. | 418/1 |

FOREIGN PATENT DOCUMENTS

| | | |
|---|---|---|
| 401 741 | 12/1990 | European Pat. Off. . |
| 529660 | 8/1992 | European Pat. Off. . |
| 508380 | 7/1920 | France . |
| 4129897 | 3/1993 | Germany . |
| 62-048979 | 3/1987 | Japan . |
| 2193534 | 2/1988 | United Kingdom . |
| 2214572 | 9/1989 | United Kingdom . |

OTHER PUBLICATIONS

Abstract of Published Japanese Patent Application No. JP 61–47166.
Abstract of Published Japanese Patent Application No. JP 61–123777.
Abstract of Published Japanese Patent Application No. JP 51–41367.

*Primary Examiner*—Timothy S. Thorpe
*Assistant Examiner*—Ehud Gartenberg
*Attorney, Agent, or Firm*—Evenson, McKeown, Edwards & Lenahan, P.L.L.C.

[57] ABSTRACT

An oil-free two-stage vacuum pump includes first and second pump stages coupled in series. The first and second pump stages have discharge spaces capable of communicating with each other via a bypass passage. The bypass passage is provided with a pressure control valve which is closed when pressure in the bypass passage is lower than a predetermined pressure. This permits a reduction in scroll size. In addition, the pump is free from problems present in pumps with large scroll sizes such as drive shaft vibrations due to warping thereof at high speed rotation, noise and heat generation, and durability reduction due to causes such as non-uniform contact between stationary and revolving scrolls. Moreover, in a compression step in the first pump stage, withdrawn gas is under high pressure; the gas pressure in a sealed vessel is close to the atmospheric pressure in an initial stage of driving. With a pressure increase beyond a predetermined pressure, a pressure control valve is opened so that compressed gas under high pressure is no longer supplied to the second pump stage; the compressed gas is instead exhausted to the outside environment. The second pump stage thus does not withdraw compressed gas under a pressure higher than atmospheric pressure, and is free from heat generation that might result from excessive compression.

10 Claims, 7 Drawing Sheets

Fig. 4(a)
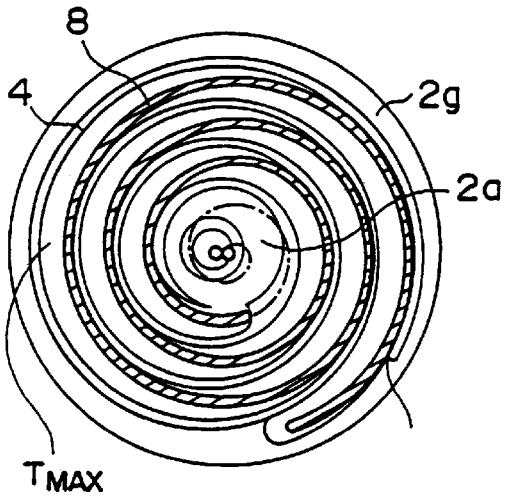
Fig. 4(d)
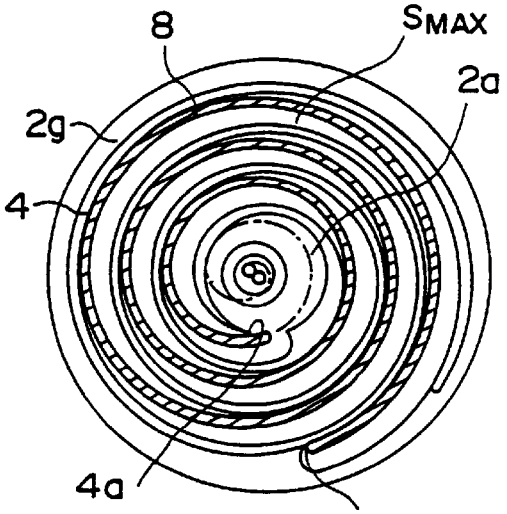
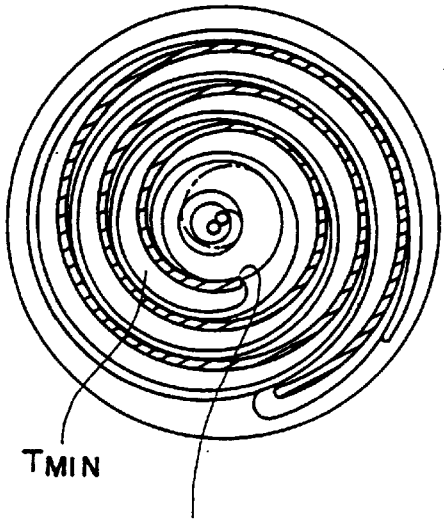
Fig. 4(b)
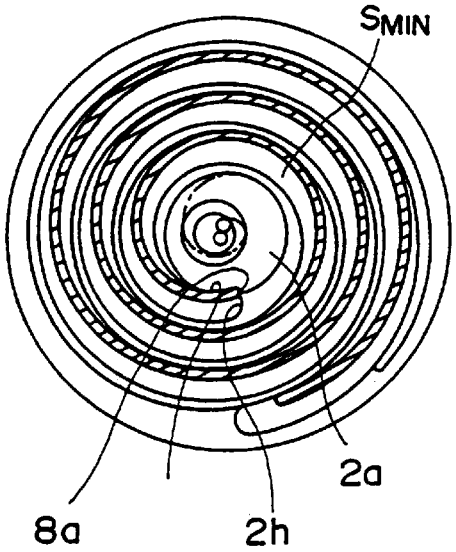
Fig. 4(c)

Fig. 5(a)
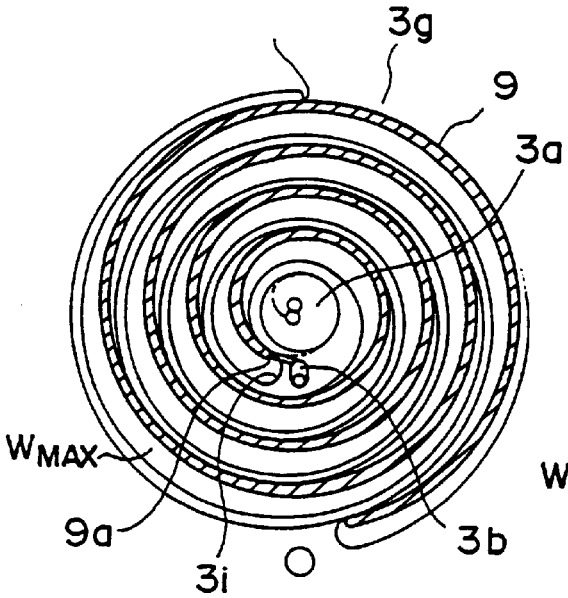
Fig. 5(d)
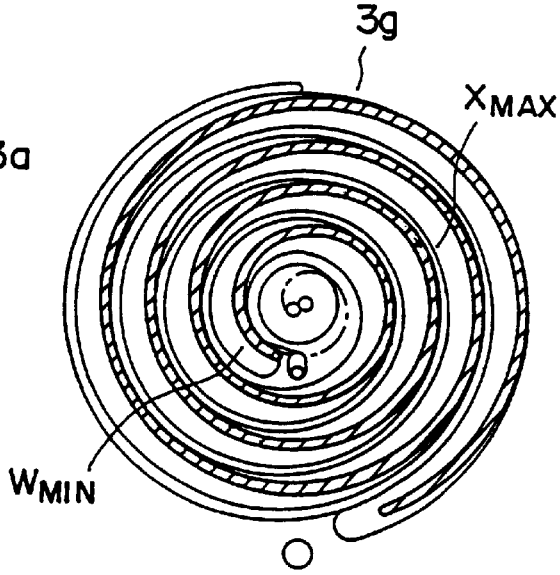
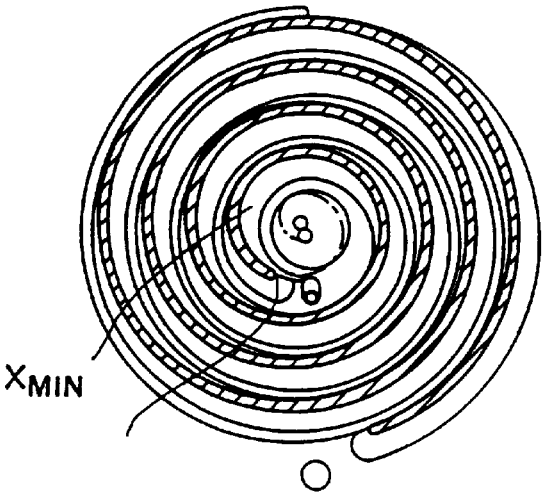
Fig. 5(b)
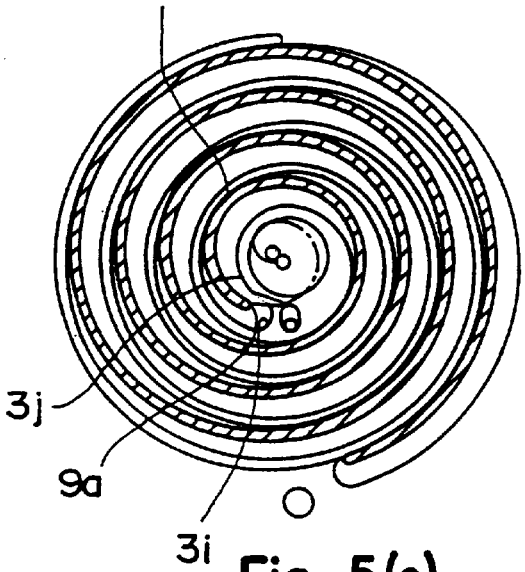
Fig. 5(c)

OIL-FREE TWO STAGE SCROLL VACUUM PUMP AND METHOD FOR CONTROLLING THE SAME PUMP

BACKGROUND OF THE INVENTION

1. Field of the Invention

This invention relates to an oil-free vacuum pump comprising a two-stage integral scroll pump for evacuating a vessel.

2. Description of Related Art

In a pump of the stationary/revolving scroll type, a revolving scroll is revolved about a stationary scroll without being rotated, thus varying the volume of a closed space formed between two laps.

The revolving scroll is caused to undergo revolution with a fixed radius about the center of the lap of the stationary scroll such that the point of contact between the two laps defining the closed space noted above, which functions as a compression chamber, is gradually shifted toward the center of the system. Gas, which is withdrawn from an intake, is led around the winding end of the second lap to enter the closed space between the two laps. With the revolution of the revolving scroll, the withdrawn gas is pressurized as it is shifted toward the system center while its volume is reduced and, when the closed space is connected with a discharge port, the gas is exhausted to the outside.

Nowadays, along with a demand for vacuum degree increase, a reduction of the time of operation until a desired vacuum degree is obtained is demanded.

Low compression ratio vacuum pumps require considerable time for evacuation, and therefore high compression ratio vacuum pumps are desired.

The high compression ratio can be increased by increasing the turn number of the spiral scrolls. Increasing the turn number of a scroll, however, increases the outer size of the scroll, thus giving rise to problems such as shaft vibration due to sagging at high rotational speeds, and also generation of noise, heat and wear caused by non-uniform contact between the stationary and revolving scrolls.

To solve these problems, it is conceivable to use two vacuum pumps, which have small scroll turn numbers and thus small scroll sizes, and to drive these pumps by coupling the intake port of the second stage pump to the discharge port of the first one.

When this method of driving (i.e. coupling or connecting) is adopted, however, in an initial stage of pumping, the pressure in the sealed vessel connected to the system is close to the atmospheric pressure. A high pressure is built up in the inter-scroll space due to the high compression ratio, resulting in the generation of high heat. In this case, it is necessary to cause the compressed gas under high pressure to escape to the outside.

As a related technique, Japanese Laid-Open Patent Publication No. 62-48979 discloses a structure for reducing the pump load at the start of the pump. Specifically, when the pressure in a first space defined by a stationary scroll and a revolving scroll becomes higher than the pressure in the next space, the gas in the first space is exhausted through a valve into the second space, so that the gas is exhausted to the outside when the second space is vented through a discharge port or vent connected with the outside.

In this technique, a vent is provided in a central part of a polished member of the stationary scroll, and a valve chamber is provided near the discharge port. The valve chamber is connected with a first connection hole, which is open to a first closed space or gas pocket defined by stationary and revolving scrolls and is led from the end of the revolving scrawl into the first gas pocket. The valve chamber is also connected with a second connection hole, which is formed near the discharge port and is open to a second closed space or gas pocket defined by stationary and revolving scrolls during compression of gas before compressed gas is exhausted to the outside and also when compressed gas is exhausted from the discharge port to the outside. A valve is provided in the opening of the first connection hole in the valve chamber. In this structure, when the pressure in the first gas pocket becomes higher than that in the second gas pocket, the valve is opened to cause the gas in the first gas pocket to be exhausted into the second gas pocket.

It is conceivable to apply this technique to driving two small scroll size, small scroll turn number vacuum pumps by coupling the intake of the second stage pump to the discharge port of the first stage pump. In this case, the valve may be provided on the first stage pump, so that an increase of the pressure in the first gas pocket beyond a predetermined level causes the first connection hole to be opened by the valve to exhaust the compressed gas in the first gas pocket into the second gas pocket.

With the revolution of the revolving scroll, however, the second gas pocket is connected with the discharge port, which is connected with the intake of the second stage pump.

Consequently, gas that has been compressed in the first stage pump is entirely led to the second stage pump. Therefore, like the first stage pump, high pressure is also built up in the second stage pump gas pocket defined by the stationary and revolving scrolls, thus resulting in high heat generation.

OBJECTS AND SUMMARY OF THE INVENTION

This invention relates to a vacuum pump which can reduce heat generation even in the range of a low vacuum.

An object of the invention is to provide a two-stage oil-free integral scroll pump which can eliminate durability reduction due to excessive inner temperature rise.

A further object of the invention is to provide a two-stage integral scroll pump which can reduce the process time for evacuating sealed vessels.

To attain the above objects, according to a first aspect of the invention, an oil-free two-stage vacuum pump having a first pump stage and a second pump stage is provided. The pump stages are driven in series, and a discharge space of the first pump stage is communicated with a discharge space of the second pump via a bypass passage. A pressure control valve is provided on the bypass passage, the pressure control valve being closed when the prevailing pressure becomes lower than a predetermined pressure.

Since the two-stage vacuum pump has first and second pump stages which are integral with each other, the scroll size may be small, and the pump is thus free from problems posed in the case of a large scroll size, i.e., vibrations of the shaft due to warping thereof in high speed rotation, generation of noise and heat, or reduction of durability due to causes such as non-uniform contact between the stationary and revolving scrolls.

In addition, in the compression step in the first pump state, the intake of the sealed vessel to be evacuated is connected to the first pump stage and gas that is withdrawn into the first pump stage is under high pressure because the pressure in the sealed vessel is close to atmospheric pressure in an initial stage of the pump. When the pressure in the first pump stage exceeds a predetermined pressure, for instance the outside pressure, i.e., the pressure in the second pump stage discharge space, the pressure control valve is opened. As a result, the compressed gas under high pressure from the first pump stage is no longer supplied to the second stage pump but is exhausted to the outside.

Thus, the second pump stage has no possibility of withdrawing compressed gas under a pressure above the atmospheric pressure and is free from heat generation due to otherwise possible excessive compression. The second pump stage, in other words, is free from possible durability reduction or seizure and breakage due to heat generated by high pressure.

Suitably, the first and second pump stages are mounted on a common shaft and are integral with each other and connected to a common drive source via the common shaft. With this structure, it is possible to provide a compact vacuum pump which is driven from a single drive source and has a reduced number of components.

Suitably, each of the first and second pump stages independently comprises a stationary scroll and a revolving scroll, with the laps of these scrolls in engagement with each other, and the first and second pump stages are disposed such that the stationary scroll of the former and the revolving scroll of the latter face each other to supply compressed air from the first pump stage through an outlet thereof provided in the stationary scroll to the revolving scroll of the second pump stage.

Suitably, the compression ratio of the second pump stage is set to be higher than that of the first pump stage. This permits withdrawal of an increased quantity of gas from the sealed vessel as load into the first pump stage having a predetermined volume. It is thus possible to reduce the process time.

Suitably, the maximum gas pocket volume of the second pump stage is set to be smaller than the minimum gas pocket volume of the first pump stage. With this arrangement, the second pump stage does not take in a greater volume of gas than the volume exhausted from the first pump stage. Thus, inflation of gas does not result in the initial, i.e., maximum volume gas pocket of the second pump stage, and the compression efficiency thereof is not reduced.

Suitably, the first and second pump stages have different scroll lap heights from the scroll lap support surface. This permits readily determining the gas pocket volume of the scroll mechanism by setting the scroll lap height with a predetermined scroll outer diameter.

BRIEF DESCRIPTION OF THE DRAWINGS

FIG. 2(*b*) is a sectional view taken along line IIb—IIb in FIG. 1;

FIGS. 4(*a*) to 4(*b*) are views referred to in the description of the operation of a first pump stage;

FIGS. 5(*a*) to 5(*d*) are views referred to in the description of the operation of a second pump stage;

DETAILED DESCRIPTION OF THE PREFERRED EMBODIMENTS

Figure 1:
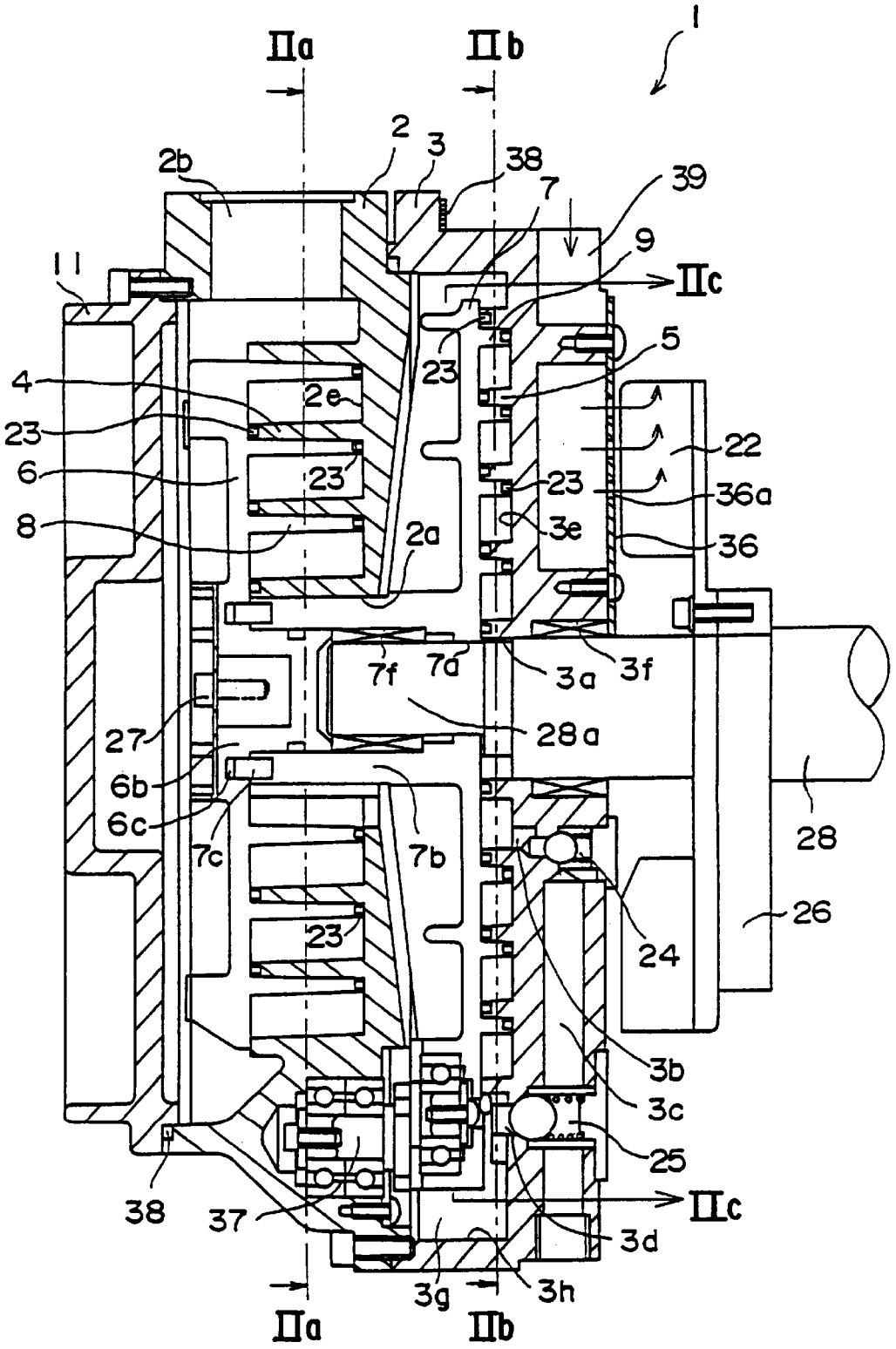
FIG. 1 is a sectional view showing an oil-free vacuum pump as a first embodiment of the invention.

FIG. 1 shows, in a sectional view, an oil-free two-stage vacuum pump as a first embodiment of the invention. Referring to FIG. 1, the oil-free two-stage vacuum pump as a first embodiment of the invention is designated generally at 1 and basically comprises housing parts 3 and 11 defining a housing space, two stationary scroll laps 4 and 5 disposed in a housing space defined by housing parts 3 and 11, two revolving scroll laps 8 and 9 embedded in revolving scroll blades 6 and 7 also disposed in the housing space in correspondence to the respective stationary scroll laps 4 and 5, a drive shaft 28 extending into the housing space for driving the revolving scroll blades 6 and 7, and a fan 22 mounted on the drive shaft 28 and for cooling the housing part 3.

The housing part 3 has its end wall 3*e* formed with a central hole 3*a* with a right part thereof having a greater diameter spot facing 3*f*. The drive shaft 28, which is coupled to a motor (not shown) , is rotatably fitted in the hole 3*a* and supported in a bearing provided in the spot facing 3*f*.

The outer surface of the end wall of the housing part 3 has a plurality of radially spaced-apart ribs 39 extending from its center toward its edge, and a cover 36 having a plurality of vent holes 36*a* is mounted on the ribs 39. With the rotation of the fan, cooling air entering from above in FIG. 1 flows to the right as shown by arrows.

The second pump stage scroll lap 5, which has a spiral shape, is embedded in an end wall 3*e* of the housing part 3. A tip seal 23, having a self-lubricating property and being elastic in the thrust direction, is fitted in the tip face of the scroll lap 5.

Near the hole 3*a*, a hole 3*b* for exhausting compressed gas is provided. The hole 3*b* can be coupled by a check valve 24 to a discharge port 3*c* connected with the outside.

When the pressure of compressed gas in the hole 3*b* exceeds the outside atmospheric pressure, the check valve 24 is opened to connect the hole 3*b* with the discharge port 3*c* so as to exhaust the compressed gas to the outside. When the pressure of compressed gas in the hole 3*b* becomes lower than the atmospheric pressure, the check valve 24 is closed to allow reverse flow of external gas into the hole 3*b*. In this way, no extra drive load is given at the time of the start of the pump.

The housing part 3 has an independent peripheral wall 3*h* surrounding its end wall 3*e* in order to maintain its gas tightness on the side of the end wall 3*e*. The end wall 3*e* has another hole 3*d*, which is formed adjacent the outer periphery of the second pump stage stationary scroll lap 5 and also adjacent the inner surface of the peripheral wall 3*h*. The hole 3*d* can be coupled by a pressure control valve 25 to the discharge port 3*c* connected with the outside.

When the pressure of compressed gas in a closed space or gas pocket 3*g* defined by the peripheral wall 3*h* and the second pump stage stationary scroll lap 5 exceeds the outside atmospheric pressure, the pressure control valve 25 is opened to connect the hole 3*d* with the discharge port 3*c* so as to exhaust the compressed gas to the outside. When the pressure in the gas pocket 3*g* becomes lower than the atmospheric pressure, the pressure control valve 25 is closed so that the second pump stage withdraws the compressed gas under high pressure. The temperature inside the second pump stage is thus controlled such that it is not elevated beyond a predetermined temperature.

The second pump stage revolving scroll lap 9, which has substantially the same spiral shape as the second pump stage stationary scroll lap 5 noted above, is embedded in the second pump stage scroll blade 7 disposed in the housing part 3. The laps 5 and 9 engage each other in a 180-degree out-of-phase relation to each other.

In a preferred case, the maximum and minimum volumes of the gas pocket defined by the stationary and revolving scroll laps 5 and 9 of the second pump stage are set to 56.6 cc and 19.1 cc, respectively, and the volume ratio (i.e., the maximum volume divided by the minimum volume, which is the compression ratio) is set to 2.96.

The revolving scroll blade 7 has a central cylindrical boss 7*b* having a central bore 7*a* with a left part thereof having a greater diameter spot facing 7*f*, in which a bearing is supported. The drive shaft 28, coupled to the motor (not shown), has an eccentric extension 28*a* which is rotatably supported in the bearing provided in the spot facing 7*f*.

The end face of the cylindrical boss 7*b* has a plurality of positioning pins 7*c* projecting from it for engaging in positioning holes of and positioning the first pump stage revolving scroll blade 6 to be described later in detail and also has a plurality of threaded holes for securing the scroll blade 6 to the boss 7*b*.

A tip seal 23, which has a self-lubricating property and is elastic in the thrust direction like the one fitted in the tip face of the scrawl lap 5, is fitted in the tip face of the second pump stage revolving scroll lap 9 provided in the scroll blade 7 noted above. Specifically, the tip faces of the scroll laps 5 and 9, which are in contact with the scroll blades 9 and 5, respectively, have seal grooves in which the self-lubricating tip seals 23 are fitted for lubricant-free sliding over the corresponding scroll blades. The tip seals 23 thus maintain the gas tightness of the gas pocket defined by the scroll laps 5 and 9 with respect to the outside.

The surface of the second pump stage revolving scroll blade 7 on the side thereof opposite the lap 9 is provided adjacent its edge with three revolving mechanism couplers. These couplers are disposed with a radial spacing angle of 120 degrees and coupled to respective revolving mechanisms 37 with crankshafts coupled to a housing part 2 of the first pump stage to be described later.

With rotation of the drive shaft 28, the revolving scroll blade 7 thus is reciprocated vertically in FIG. 1 and undergoes revolution in correspondence to the length of the crankshafts of the revolving mechanisms 37. That is, the revolving scroll blade 7 can revolve about the center of the stationary scroll lap 5 with a predetermined radius without being rotated.

The housing 2 is secured via a packing 38 to the housing part 3 by bolts or the like. The inner wall 2*e* of the housing part 2 has a central hole 2*a*, in which the cylindrical boss 7*b* of the second pump stage revolving scroll blade 7 is rotationally slidably fitted.

The peripheral wall of the housing part 2 has a withdrawal hole 2*b*, which is coupled to a sealed vessel (not shown) for withdrawing gas therefrom. The first pump stage scroll lap 4, which also has a spiral shape, is embedded in the surface of the inner wall 2*e* of the housing part 2. A tip seal 23, having a self-lubricating property and which is elastic in the thrust direction, is again fitted in the tip face of the lap 4.

The first pump stage revolving scroll lap 8, which has substantially the same spiral shape as the stationary scroll lap 4 of this pump stage, is embedded in the first pump stage revolving scroll blade 6. The laps 4 and 8 are disposed in the housing part 2 in the 180-degree out-of-phase relation to each other.

In a preferred case, the maximum and minimum volumes Vmax and Vmin of the gas pocket defined by the stationary and revolving laps 4 and 8 of the first pump stage are set to 189.7 and 82.7 cc, respectively, and the volume ratio is set to 2.29.

The first pump stage scroll blade 6 has a central cylindrical portion 6*b* extending in the embedding direction of the lap 8. Near the cylindrical portion 6*b*, the scroll blade 6 has positioning holes 6*c* which are fitted on the pins 7*c* provided on the cylindrical boss 7*b* of the second pump stage revolving scroll blade 7. The first pump stage scroll blade 6 is secured to the second pump stage revolving scroll blade 7 by bolts 27 inserted through bolt holes provided in a row near the positioning holes 6*c*.

Like the tip seal 23 fitted in the tip face of scroll lap 4, a tip seal 23 having a self-lubricating property and being elastic in the thrust direction is fitted in the tip face of the first pump stage revolving scroll lap 8. As described above, the tip faces of the scroll laps 4 and 8, which are in contact with the corresponding scroll blades, have seal grooves, in which the tip seals 23 are fitted for lubricant-free sliding over the corresponding scroll blade, so the seal tips 23 maintain the gas tightness of the gas pocket defined by the laps 4 and 8 with respect to the outside.

The housing part 11 is secured via a packing 38 to the housing part 2.

Figure 7:
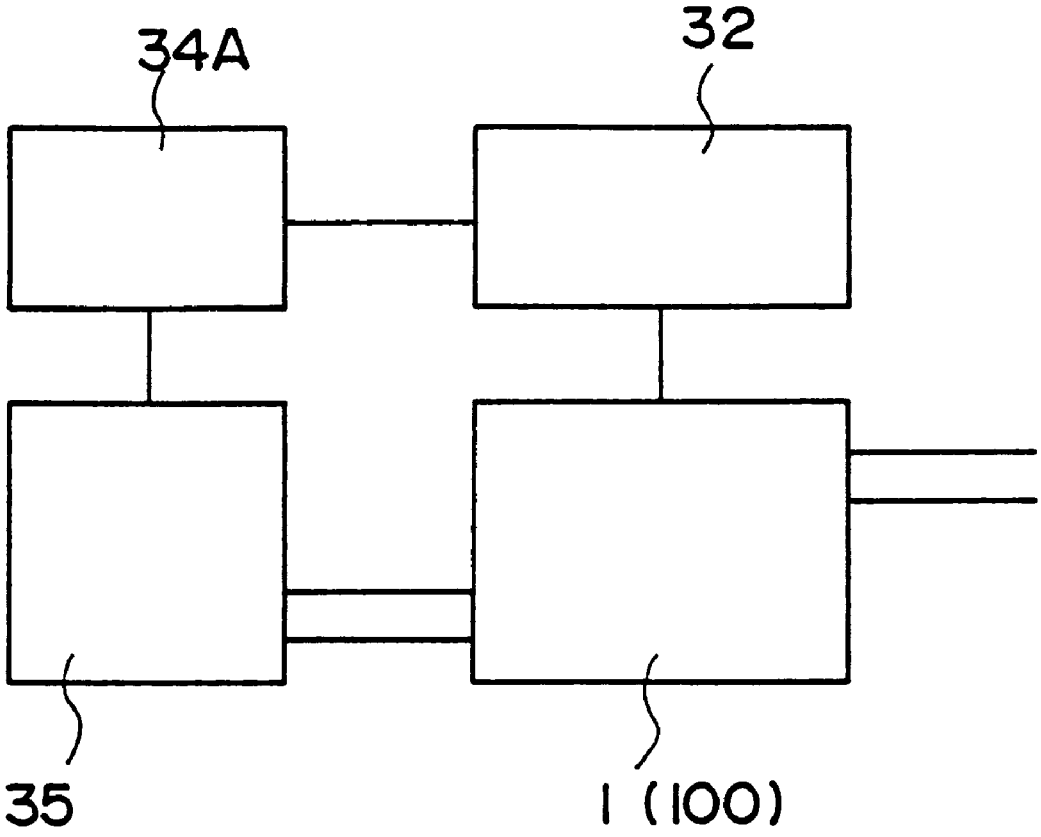
FIG. 7 is a block diagram referred to in the description of controllers for driving the first and second embodiments of the oil-free vacuum pump.

FIG. 7 is a block diagram showing a controller for controlling a vacuum pump with a scroll mechanism formed by a combination of a stationary scroll and a revolving scroll. The intake of a sealed vessel 35 is connected to the intake of the vacuum pump body 1 driven by a motor 32, which is in turn controlled by an electronic controller 34A. The electronic controller 34A includes measuring means for measuring the gas pressure in the sealed vessel 35, and the rotation rate of the motor 35 is controlled according to the measurement value obtained by the measuring means.

The operation of the embodiment shown in FIG. 1 will now be described.

As shown in FIGS. 1 and 7, the intake 2*b* of the vacuum pump body 1 is coupled by piping to the intake port of the sealed vessel 35, and the drive shaft 28 of the vacuum pump body 1 is coupled to the motor 32 which is in turn coupled to the electronic controller 34A. When the motor 32 is driven by the electronic controller 34A, the first and second pump stage scroll blades 6 and 7 start rotation.

Figure 2A:
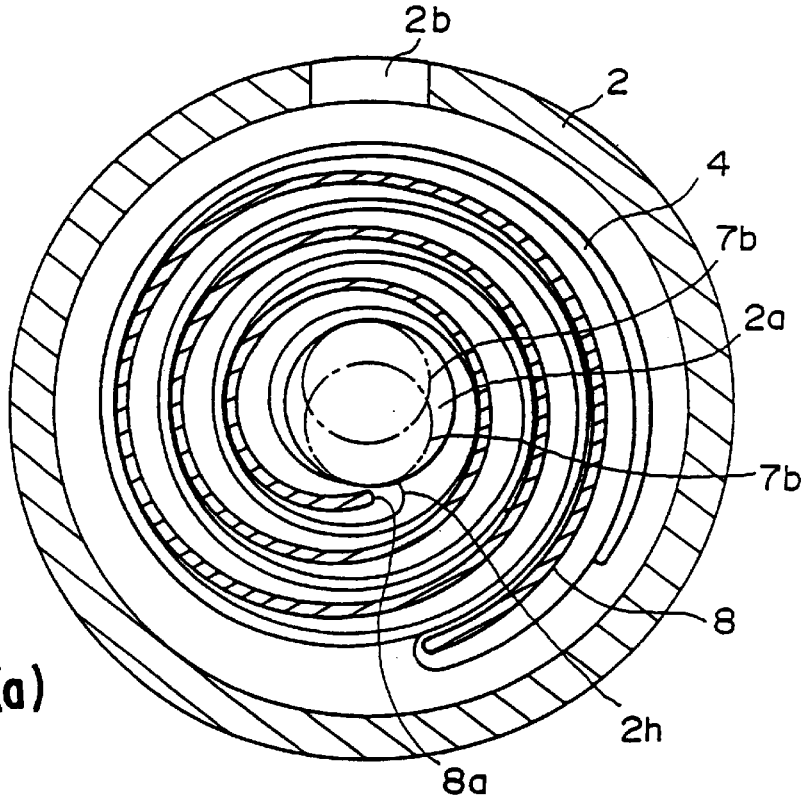
FIG. 2(*a*) is a sectional view taken along line IIa—IIa in FIG. 1.
Figure 2B:
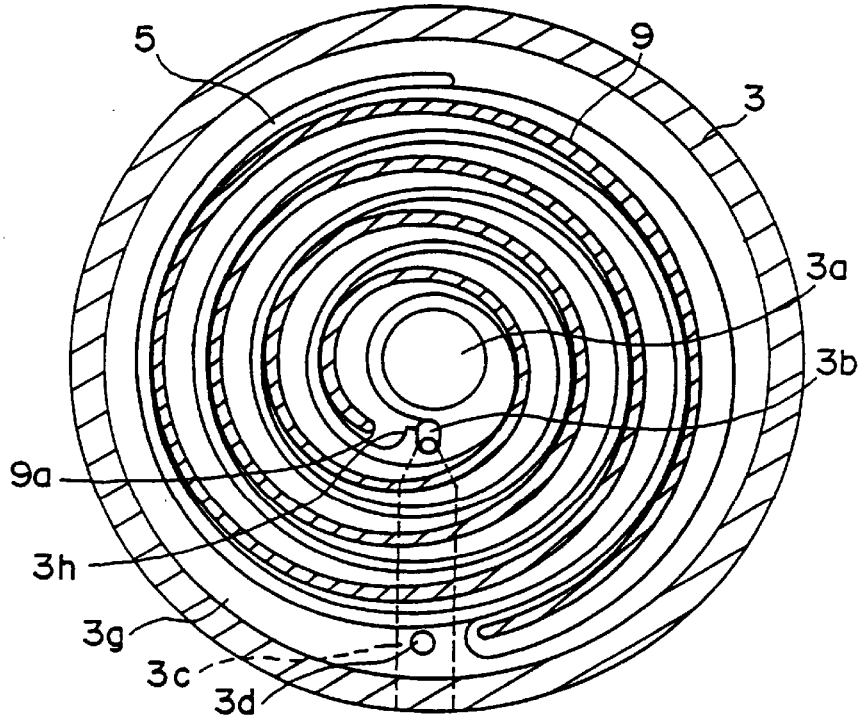
Figure 3:
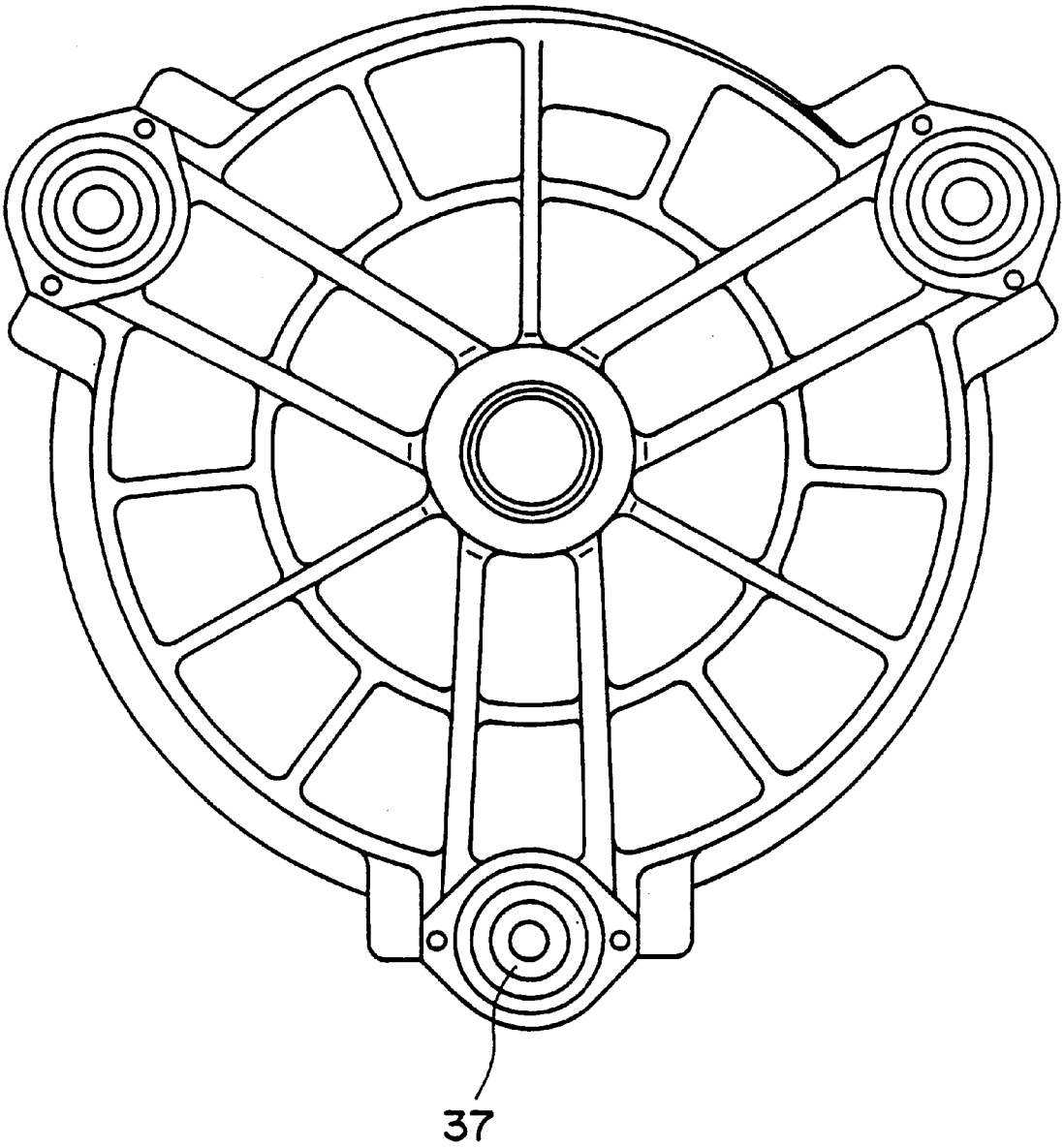
FIG. 3 is a sectional view taken along line IIc—IIc in FIG. 1.

With the rotation of the drive shaft 28, the cylindrical boss 7*b* of the second pump stage scroll blade 7 that is eccentric with the drive shaft 28 is rotated in correspondence to the crankshaft length of the revolving mechanisms 37 (FIG. 3) and thus vertically reciprocates in the hole 2*a* of the housing part 2 in frictional contact with the surface of the hole 2*a* as shown in FIG. 2(*a*). That is, the revolving scroll blade 7 is rotated counterclockwise with a predetermined radius thereof about the center of the stationary scroll lap 4 without being rotated.

The first pump stage revolving scroll lap 8 thus is rotated in the counterclockwise direction in FIG. 2(*a*) in frictional contact with wall surface of the first pump stage stationary scroll lap 4, and the end 8*a* of the lap 8 is rotated under restriction of and along an R-shaped wall surface 2*h* extending from the end of the lap 4 at the center of the housing part 2. As a result, compressed gas is exhausted through the hole 2*a*.

On the other hand, the second pump stage revolving scroll lap 9, which is integral with the bearing 7*b*, is rotated in the counterclockwise direction in FIG. 2(*b*) in frictional contact with the wall surface of the second pump stage stationary scroll lap 5. The end 9*a* of the lap 9 is rotated under restriction of and along an R-shaped wall surface 3*h* extending from the end of the lap 5 at the center of the housing part 3, so that compressed air is exhausted from the discharge port 3*b*.

The operation of this embodiment will now be described in greater detail.

When the intake 2*b* and the sealed vessel 35 are coupled together by piping, the space 2*g* (FIGS. 4(*a*) to 4(*d*)) connected with the intake 2*b*, in the housing part 2 constituting the first pump stage, is filled with gas under the same pressure as in the sealed vessel 35.

With the rotation of the first pump stage revolving scroll, the gas in the space 2*g* is withdrawn into the maximum volume gas pocket Tmax, which has its outer side defined by the stationary scroll lap 4 and its inner side defined by the revolving scroll lap 8, and also into the maximum volume gas pocket Smax, which has its outer side defined by the revolving scroll lap 8 and its inner side defined by the stationary scroll lap 4, as shown in FIGS. 4(*a*) and 4(*d*).

With the revolution of the revolving scroll lap 8, of the gas withdrawn into the maximum volume gas pockets Tmax and Smax, the gas in the gas pocket Tmax is compressed into a minimum volume gas pocket Tmin, as shown in FIG. 4(*b*). When clearance is formed between the end 8*a* of the lap 8 and the R-shaped wall surface 2*h* with further revolution of the lap 8, as shown in FIG. 4(*c*), the compressed gas is exhausted through the clearance into the hole 2*a*.

The gas withdrawn into the gas pocket Smax, on the other hand, is compressed into a minimum volume gas pocket Smin as shown in FIG. 4(*c*). When the clearance between end 4*a* of the lap 4 at the center thereof and the inner wall surface of the revolving scroll lap 8 is opened with further rotation of the revolving scroll as shown in FIG. 4(*d*), compressed gas is exhausted through the clearance into the hole 2*a*.

The exhausted compressed gas flows from the hole 2*a* toward the space 3*g* formed in the housing 3 from the central part to the outer periphery of the second pump stage scroll blade 7 to fill a space on the back side of the scroll blade 7 and the space 3*g*.

In an initial stage of driving the pump, the pressure in the sealed vessel 35 is the same as the atmospheric pressure, and the gas that is withdrawn by the first pump stage scroll fills the space 3*g* under double the atmospheric pressure.

Since the pressure in the space 3*g* is higher than the atmospheric pressure, the pressure control valve 25 disposed in the hole 3*d* connected with the discharge port 3*c* connected with the outside, is open, and the compressed gas is exhausted to the outside.

Meanwhile, in the initial stage of driving, in the second scroll mechanism stage, both the space 3*g* and also the gas pocket defined by the stationary and revolving scroll laps 5 and 9 are filled by gas substantially under the same pressure as the atmospheric pressure.

This is due to leakage of gas through a slight clearance between the stationary and revolving scroll laps. While the gas leakage can be ignored during driving, when the system is left under atmospheric pressure for long time, the pressure becomes substantially the same as the atmospheric pressure due to gas entering through the clearance noted above.

In the initial driving stage, the second pump stage scroll mechanism withdraws gas substantially under the atmospheric pressure. This mechanism withdraws and compresses atmospheric pressure gas until the pressure of the mixture of the gas exhausted from the first pump stage scroll mechanism and the gas present in the space 3*g* become lower than the atmospheric pressure.

Accordingly, the shape and dimensions of the second pump stage scroll mechanism are designed from considerations of the temperature characteristics of the tip seals 23 fitted in the lap tip faces, rotational speed of the revolving scroll, the maximum volume of gas withdrawn by the revolving scroll, the compression ratio, cooling performance of the fan 22, time until the gas pressure in the space 3*g* becomes lower than the atmospheric pressure, etc., and it is operated within these design basis ranges.

With the rotation of the second pump stage revolving scroll, the gas in the space 3*g* is withdrawn into the maximum volume gas pocket Wmax, which has its outer side defined by the stationary scroll lap 5 and its inner side defined by the revolving scroll lap 9, and also into the maximum volume gas pocket Xmax, which has its outer side defined by the revolving scroll lap 9 and its inner side defined by the stationary scroll lap 5, as shown in FIGS. 5(*a*) and 5(*d*).

With the revolution of the revolving scroll lap 9, of the gas withdrawn into the maximum volume gas pockets Wmax and Xmax, the gas in the gas pocket Xmax is compressed into a minimum volume gas pocket Xmin as shown in FIG. 5(*b*). When the clearance between the end 9*a* of the lap 9 and the wall surface 3*j* of the central part of the stationary scroll lap 5 is opened with further rotation of the revolution of the lap 9, as shown in FIG. 5(*c*), the compressed gas is exhausted through the clearance into the hole 3*b*.

The gas withdrawn into the gas pocket Wmax, on the other hand, is compressed into a minimum gas pocket Wmin as shown in FIG. 5(*d*). When a clearance is formed between the R-shaped wall surface 3*i* at the center of the lap 5 and the end 9*a* of the revolving scroll 9, the compressed gas is exhausted through the clearance into the hole 3*b*.

As the pressure in the sealed vessel 3S is reduced with the progress of the evacuation of the vessel, the amount of gas withdrawn is reduced.

By detecting this pressure reduction, the electronic controller 34A increases the rotation speed of the motor 32 to make up for the reduction of the amount of withdrawn gas.

The rotation speed of the motor may be controlled as well after the lapse of a predetermined period of time with such parameters as the volume of the sealed vessel, performance of the vacuum pump, etc. inputted in advance to the electronic controller 34A.

As shown above, while the second scroll mechanism stage can compress gas substantially under the atmospheric pressure for exhaustion to the outside, compressed gas under pressure in excess of the atmospheric pressure, supplied from the first scroll mechanism stage, is bypassed by the pressure control valve to be exhausted to the outside. Thus, the second scroll mechanism stage neither withdraws nor compresses excess pressure gas, so that it is free from durability reduction or breakage that might otherwise result from high heat generation.

Figure 6:
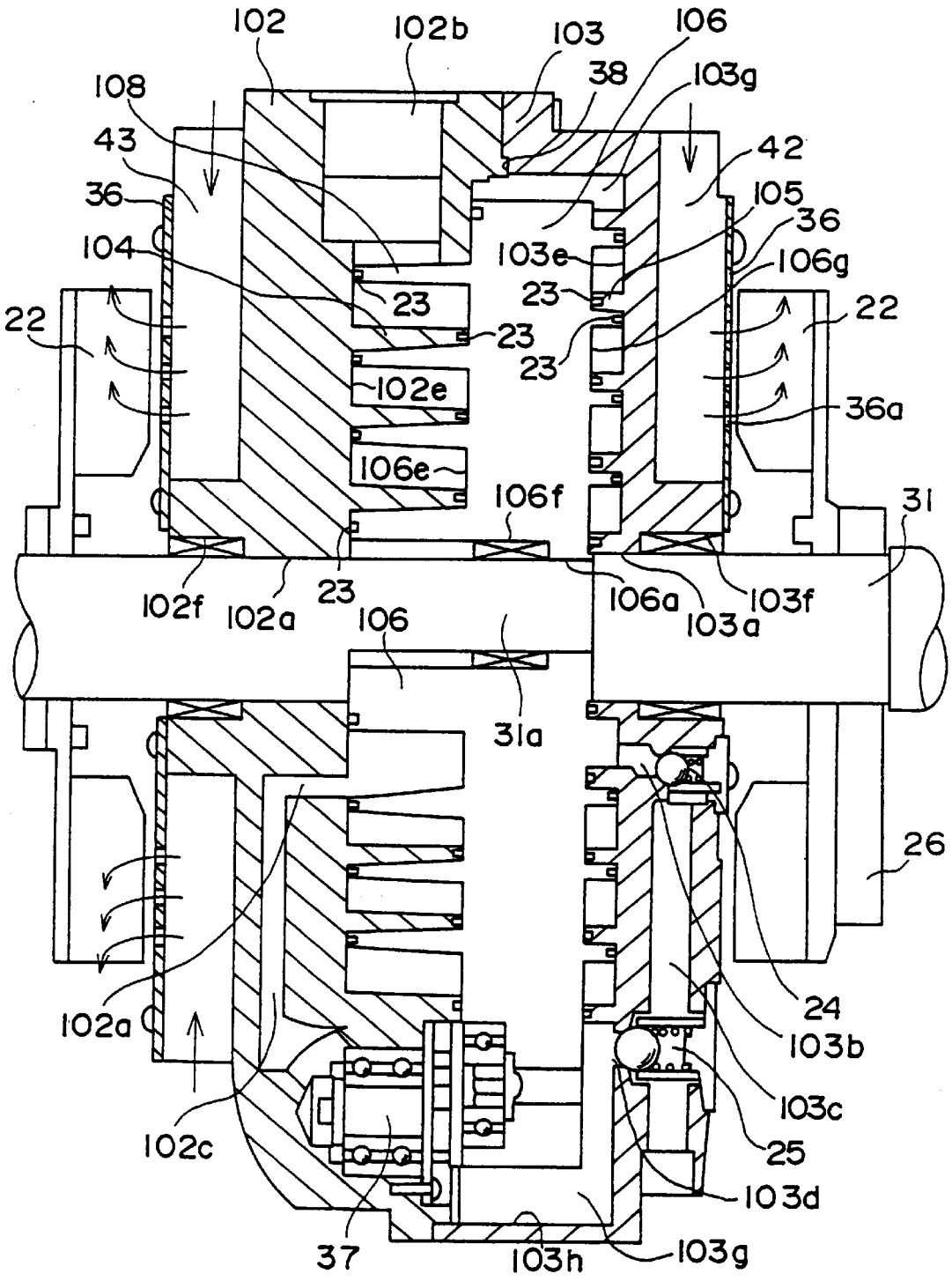
FIG. 6 is a sectional view showing an oil-free vacuum pump as a second embodiment of the invention.

FIG. 6 shows an oil-free two-stage vacuum pump as a second embodiment of the invention.

Referring to FIG. 6, the oil-free two-stage vacuum pump as a first embodiment of the invention is designated generally at 100 and basically comprises housing parts 102 and 103 defining a housing space, two stationary scroll laps 104 and 105 disposed in the housing space, two revolving scroll laps 108 and 109 embedded in revolving scroll blades 106 and 107, also disposed in the housing space in correspondence to the respective stationary scroll laps 104 and 105, a drive shaft 31 extending into the housing space for driving the revolving scroll, and a fan 22 mounted on the drive shaft 31 for cooling the housing parts 103 and 102.

The housing part 103 has its end wall 103*e* formed with a central hole 103*a* with a right part thereof having a greater diameter spot facing 103*f* for supporting a bearing. The drive shaft 31, which is coupled to a motor (not shown), is rotatably fitted in the hole 103*a* such that it is supported in the bearing fitted in the spot facing 103*f*.

The outer surface of the end wall of the housing part 103 has a plurality of radially spaced-apart ribs 42 extending from its center toward its edge. A cover 36 having a plurality of vent holes 36*a* is mounted on the ribs 42. With the rotation of the fan 22, cooling air entering the space defined by the housing part 3 and cover 36 from above in FIG. 6 flows to the right as shown by arrows.

The second pump stage scroll lap 15, which has a spiral shape, is embedded in an end wall 103*e* of the housing part 103. A tip seal 23, having a self-lubricating property and being elastic in the thrust direction, is fitted in the tip face of the scroll lap 105.

Near the hole 103*a*, a hole 103*b* for exhausting compressed gas is provided. This hole can be coupled by a check valve 24 to a discharge part 103*c* communicated with the outside.

When the pressure of compressed gas in the hole 103*b* exceeds the atmospheric pressure in the outside, the check valve 24 is opened to connect the hole 103 with the discharge port 103*c* so as to exhaust the compressed gas to the outside. When the pressure of compressed gas in the hole 103 becomes lower than the atmospheric pressure, the check valve 24 is closed to allow reverse flow of external gas into the hole 103*b*. In this way, no extra drive load is given at the time of the start of the pump.

The housing part 103 has an independent peripheral wall 3*h* surrounding its end wall 3*e* in order to maintain its gas tightness on the side of the end wall 103*e*. The end wall 103*e* has another hole 103*d*, which is formed adjacent the outer periphery of the second pump stage stationary scroll lap 105 and also adjacent the inner surface of the peripheral wall 103*h*. The hole 103*d* can be coupled by a pressure control valve 25 to the discharge port 103*c* connected with the outside.

When the pressure of compressed gas in a closed space or gas pocket 103*g* defined by the peripheral wall 103*h* and the second pump stage stationary scroll lap 105 exceeds the atmospheric pressure in the outside, the pressure control valve 25 is opened to communicate the hole 3*d* with the discharge port 103*c* so as to exhaust the compressed gas to the outside. When the pressure in the gas pocket 103*g* becomes lower than the atmospheric pressure, the pressure control valve 25 is closed so that the second pump stage withdraws the compressed gas under high pressure. The temperature inside the second pump stage is thus controlled such that it is not elevated beyond a predetermined temperature.

The housing part 102 is secured via a packing 38 and by bolts to the housing part 103.

The outer periphery of the housing part 102 has a hole 102*b* coupled to a sealed vessel (not shown) for withdrawing gas therefrom. The first pump stage scroll lap 104, which has a spiral shape, is embedded in the inner wall 102*e* of the housing 102. A tip seal 23 having a self-lubricating property and elastic in the thrust direction is fitted in the tip face of the lap 104.

The inner wall 102*e* of the housing part 102 has a central bore 102*a* with a left part thereof formed with a greater diameter spot facing 102*f* for supporting a bearing. The drive shaft 31 coupled to a motor (not shown) is rotatably fitted in the bore 102*a* such that it is supported in the bearing fitted in the spot facing 102*f*.

The outer surface of the end wall of the housing part 102 has a plurality of radially spaced-apart ribs 43 extending from the center toward its periphery. A cover 36 having a plurality of vent holes 36*a* is mounted on the ribs 43. With the rotation of the fan 22, cooling air entering the space defined by the housing part 102 and the cover 36 flows to the left as shown by arrows in FIG. 6.

The inner wall of the housing part 102 is formed near its center with a hole 102*a* for exhausting compressed gas therethrough, compressed gas being thence supplied through a discharge passage 102*c* to the second pump stage scrolls.

Three revolving mechanisms 37 have their stems provided at 120-degree angle intervals on the housing part 102 adjacent the periphery thereof and have one end coupled to the revolving scroll blade 106.

The first pump stage revolving scroll lap 108, which has substantially the same spiral shape as the first pump stage stationary scroll lap 104, is embedded in the revolving scroll blade 106 provided in the housing space 102. The laps 104 and 108 engage each other in a 180-degree out-of-phase relation to each other.

In a preferred case, the maximum and minimum volumes Vmax and Vmin of the gas pocket, defined by the stationary and revolving scroll laps 4 and 8 of the first pump stage, are set to 189.7 and 82.7 cc, respectively, and the volume ratio is set to 2.29.

The second pump stage revolving scroll lap 107, which has substantially the same spiral shape as the second pump stage stationary scroll lap 105, is embedded in the surface 106*g* of the revolving scroll blade 106. The laps 105 and 107 engage each other in a 180-degree out-of-phase relation to each other.

In a preferred case, the maximum and minimum volumes of the gas pocket, defined by the stationary and revolving scroll laps 15 and 19 of the second pump stage, are set to 56.6 and 19.1 cc, respectively, and the volume ratio is set to 2.96.

Three pin crankshaft mechanisms 37 have their stems provided at a 120-degree angle interval on the revolving scroll blade 106 adjacent the periphery thereof and have their stems coupled to the housing part 102.

The revolving scroll blade 106 has a central eccentric cylindrical boss 106*b*, which extends in the direction of embedding of the lap 108 and is rotatably coupled to an extension 31*a* of the drive shaft 31 with an end of the lap 108 in contact via a tip seal 23 with a polished surface 102*e* of the housing part 102.

The central cylindrical boss 106*b* of the blade 106 has a central bore 106*a* with a left part thereof formed with a greater diameter spot facing 106*f* for supporting a bearing. The eccentric extension 31*a* of the drive shaft 31, coupled to a motor (not shown), is rotatably supported in the bearing provided in the spot facing 106*f*.

The operation of the embodiment shown in FIG. 6 and having the above construction will now be described with reference to FIG. 7.

Referring to FIG. 7, the electric controller 34A drives the motor 32 to drive the revolving scroll blade 106.

Referring to FIG. 6, gas substantially under the same pressure as the atmospheric pressure is withdrawn into the intake 102*b* provided in the housing part 102. The withdrawn gas is taken and compressed by the revolving and stationary scroll laps 108 and 104 of the first pump stage, and compressed gas is withdrawn through the hole 102*a* into the space 103*g* in the housing part 103.

In an initial stage of pump driving, the pressure in the sealed vessel 35 is the same as the atmospheric pressure, and the gas taken by the first pump stage scrolls is compressed to about double the atmospheric pressure to fill the space 103*g*.

Since the space 103*g* is under a pressure higher than the atmospheric pressure, the pressure control valve 25 which is disposed in the hole 103*d* connected with the discharge passage 103*c* which in turn is connected with the outside, is held opened, and the compressed gas is exhausted to the outside.

Meanwhile, in the initial pump drive stage, in the second scroll mechanism stage, not only the space 103*g* but also the gas pocket defined by the stationary and revolving scroll laps 105 and 107 is filled with gas which is substantially under the same pressure as the atmospheric pressure.

Thus, the second scroll mechanism stage, in the initial pump driving stage, takes and compresses the atmospheric pressure gas to exhaust the compressed gas into the hole 103*b* until the pressure of the mixture of the gas exhausted by the first scroll mechanism stage and the gas in the space 103*g* becomes lower than the atmospheric pressure.

With progressive evacuation of the sealed vessel 35, the pressure therein is reduced to reduce the gas withdrawal rate.

The electric controller 34A detects this pressure detection for increasing the rotation speed of the motor 32 and makes up for the gas withdrawal rate reduction.

As an alternative arrangement, the rotation speed of the motor may be controlled after the lapse of a predetermined period of time with such parameters as the volume of the sealed vessel, performance of the vacuum pump, etc. inputted in advance to the electric controller 34A.

As is clear from above, an oil-free two-stage vacuum pump in which the first and second pump stages are coupled and driven in series permits a reduction in scroll size.

The vacuum pump is thus free from problems posed by the large scroll size, such as vibrations of the shaft due to warping thereof at high speed rotation and generation of noise and heat or durability reduction due, for example, to non-uniform contact between the stationary and revolving scrolls.

In addition, the discharge space of the first pump stage is connected with the discharge space of the second pump stage via the bypass passage on which the pressure control valve is provided which is closed by pressure reduction resulting in pressure lower than a predetermined pressure. Thus, in the compression step in the first pump stage, the gas that is withdrawn into the first pump stage is under high pressure because the pressure in the sealed vessel is close to the atmospheric pressure in an initial stage from the start of the pump. When the pressure in the first pump stage exceeds a predetermined pressure, for instance the outside pressure, i.e., the pressure in the second pump stage discharge space, the pressure control valve is opened, so that the compressed gas under high pressure from the first pump stage is exhausted to the outside.

The second pump stage thus has no possibility of withdrawing compressed gas under a pressure above the atmospheric pressure, and it is free from heat generation due to excessive compression which would otherwise be possible. That is, the second pump stage is free from the possible durability reduction or seizure and breakage due to heat generated by high pressure.

The first and second pump stages may be mounted on a common shaft such that they are integral with each other and connect a common drive source via the common shaft. This permits a compact vacuum pump, which has a reduced number of components, to be provided.

It is to be appreciated that, according to the invention, a vacuum pump can be provided which can reduce heat generation even in the low vacuum viscous range and which is economical.

We claim:

1. A two-stage integral scroll pump, having a first pump stage and a second pump stage integral with each other and connected to a common drive source, comprising:

a closed space provided between a stationary scroll of the first pump stage and a stationary scroll of the second pump stage, each scroll confronting the other, the closed space communicating with a discharge port of the first pump stage and taking out gas received from said discharge port and supplied to the second pump stage;

a hole communicating said communication space with an outside environment; and a pressure control valve disposed in the hole so as to close the hole when pressure in the hole is no higher than a predetermined pressure and open the hole when the pressure in the hole becomes higher than the predetermined pressure and to permit direct discharge of compressed gas from the discharge port of the first pump stage to the outside environment through the communication space and the hole.

2. The two-stage integral scroll pump according to claim 1, and further comprising a common shaft on which the first and second pump stages are mounted such that they are integral with each other and driven by said common drive source.

3. The two-stage integral scroll pump according to claim 2, and further comprising a sealed vessel coupled to an inlet of the first pump stage and control means for controlling the rotation speed of the common drive source according to a vacuum degree of the sealed vessel.

4. The two-stage integral scroll pump according to claim 1, wherein each of the pump stages comprises a stationary scroll and a revolving scroll, the stationary scroll having a bottom wall including said hole.

5. The two-stage integral scroll pump according to claim 1, wherein each of the first and second pump stages comprises a stationary scroll and a revolving scroll, each stationary scroll has a wrap in engagement with a wrap of one revolving scroll, the first and second pump stages are disposed such that the revolving scroll of the former and the stationary scroll of the latter face each other, and compressed air from the first pump stage is supplied through said discharge port, provided in the stationary scroll thereof, to the revolving scroll of the second pump stage.

6. The two-stage integral scroll pump according to claim 1, wherein the second pump stage has a compression ratio which is higher than a compression ratio of the first pump stage.

7. The two-stage integral scroll pump according to claim 5, wherein the second pump stage has a maximum gas pocket volume which is smaller than a minimum gas pocket volume of the first pump stage.

8. The two-stage integral scroll pump according to claim 5, wherein the first and second pump stages have different scroll wrap heights as measured from the scroll wrap support surface.

9. The two-stage integral scroll pump according to claim 1, and further comprising:

a double wrap revolving scroll including a scroll base having, on a first side, a first revolving wrap for compressing gas in the first pump stage and, on a second side, a second revolving wrap for compressing gas in the second pump stage;

a first stationary scroll housing having a first stationary wrap engaged with the first revolving wrap;

a second stationary scroll housing having a second stationary wrap engaging with the second revolving wrap;

a shaft rotatably supported by shaft supports of the first and second stationary scroll housings and having a central portion with an axis of rotation eccentric to an axis of rotation of said shaft supports, the central portion being coupled to the double-wrap revolving scroll; and fans, provided on the opposite ends of the shaft, for cooling the first and second stationary scroll housings from respective backs thereof.

10. The two-stage integral scroll pump according to claim 1, wherein the second pump stage has a compression ratio which is higher than a compression ratio for the first pump stage and a scroll wrap height from a scroll base is smaller in the second pump stage than in the first pump stage so as to make a maximum gas pocket volume in the second pump stage smaller than a minimum gas pocket volume in the first pump stage.

* * * * *